United States Patent [19]

Mailand et al.

[11] Patent Number: 4,463,523

[45] Date of Patent: Aug. 7, 1984

[54] WEATHERSTRIP ASSEMBLY FOR ENTRY DOOR

[75] Inventors: John J. Mailand, Wyoming Township, Chisago County; Charles D. Huber, Oakdale, both of Minn.

[73] Assignee: Minnesota Mining and Manufacturing Company, Saint Paul, Minn.

[21] Appl. No.: 358,829

[22] Filed: Mar. 16, 1982

[51] Int. Cl.[3] ..... E06B 7/16

[52] U.S. Cl. ..... 49/478; 49/470; 49/485

[58] Field of Search ..... 49/470, 478, 485

[56] References Cited

U.S. PATENT DOCUMENTS 1,787,523 1/1931 Heinen ..... 49/470

4,192,101 3/1980 White ..... 49/478

*Primary Examiner*—Kenneth Downey

*Attorney, Agent, or Firm*—Donald M. Sell; James A. Smith; William L. Huebsch

[57] ABSTRACT

A weatherstrip assembly comprising an integral extrusion of polymeric material comprising a stiff portion adapted to be adhered on the vertical surface of a door with a flexible strip portion extending below the bottom edge of the door and along a threshold. A first magnetized strip is attached on the flexible portion and a second metal strip is adapted to be adhered to the surface of the threshold so that the strips will be face to face and releasably seal between the door and the threshold when the door is closed.

6 Claims, 5 Drawing Figures

WEATHERSTRIP ASSEMBLY FOR ENTRY DOOR

TECHNICAL FIELD

This invention relates to weatherstrip assemblies for use on doors, and particularly to such assemblies for use between the bottom of an entry door and its threshold.

DISCLOSURE OF INVENTION

The present invention provides an inexpensive, effective, easily installable weatherstrip assembly for use between a bottom of an entry door and its threshold.

The weatherstrip assembly according to the present invention comprises an integral polymeric extrusion. The extrusion comprises a stiff strip-like portion having first and second generally parallel edges, and a flexible strip-like portion extending from the second edge of the first portion and having an outer edge generally parallel to the second edge, with the stiff and flexible portions defining a normally planar inner surface for the extrusion. A layer of pressure-sensitive adhesive is disposed on the inner surface along the stiff portion and is adapted to adhere the stiff portion to the vertical surface of the door with the flexible portion of the extrusion extending below the bottom edge of the door. The assembly comprises a pair of magnetically attracted strips. These strips include a first strip attached on the inner surface along the flexible portion adjacent its outer edge, and a second strip. A layer of pressure-sensitive adhesive on the second strip is adapted to adhere the second strip to the inner surface of the threshold in a position to afford separable face-to-face contact of the strips due to magnetic attraction therebetween when the door is closed.

Preferably the extrusion in the weatherstrip assembly also includes a lip along the first edge of the stiff portion projecting normal to the inner surface of the extrusion to cover the adjacent edge of the layer of pressure-sensitive adhesive on the stiff portion when it is adhered to the door. This lip both keeps the edge of the adhesive from collecting dirt, and improves the esthetic appearance of the weatherstrip assembly.

BRIEF DESCRIPTION OF THE DRAWING

The present invention will be further described with reference to the accompanying drawing wherein like reference numerals refer to like parts in the several views, and where.

DESCRIPTION OF THE PREFERRED EMBODIMENT

Figure 1:
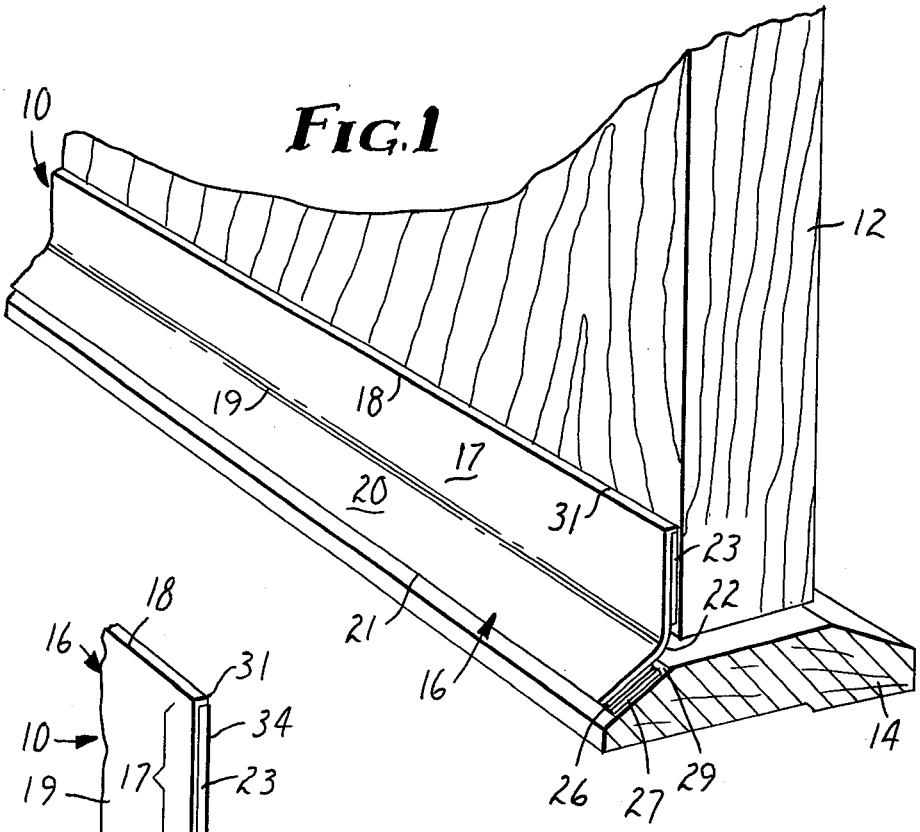
FIG. 1 having attached thereto release liners that are removed when the weatherstrip assembly is installed is a fragmentary perspective view of a weatherstrip assembly according to the present invention attached between a bottom of an entry door and its threshold.
Figure 2:
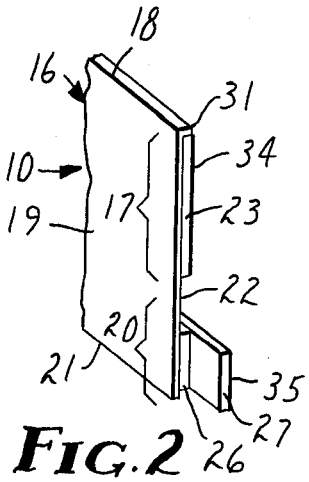
FIG. 2 is a fragmentary perspective view of the weatherstrip assembly shown in FIG. 1.

Referring now to the drawing there is illustrated a weatherstrip assembly according to the present invention, generally designated by the reference numeral 10, shown attached between a bottom portion of an entry door 12 and its threshold 14.

The weatherstrip assembly 10 comprises an integral polymeric extrusion 16, including a stiff strip-like portion 17 having first and second generally parallel edges 18 and 19, and a flexible strip-like portion 20 extending from the second edge 19 of the stiff portion 17 and having an outer edge 21 generally parallel to the second edge 19. The stiff and flexible portions 17 and 20 define an inner surface 22 which is normally planar since the extrusion 16 is extruded with the inner surface 22 planar. During such extrusion the stiff portion 17 is caused to be quite stiff and the flexible portion 20 is caused to be resiliently flexible by using different polymeric compositions for the portions by means well known in the extruding art. The assembly 10 has a layer 23 of pressure-sensitive adhesive on a foam backing (e.g., as can be provided by using No. 4992 double coated neoprene tape, 1/32 inch thick, available from 3M Company, St. Paul, MN) disposed on its inner surface 22 along the stiff portion 17 which is adapted to adhere the stiff portion 17 to the vertical surface of the door 12 with the flexible portion 20 extending below the bottom edge of the door 12. Also included in the assembly 10 is a pair of magnetically attracted strips, including a first strip 26 attached in face-to-face contact on the inner surface 22 along the flexible portion 20 adjacent its outer edge 21, and a second strip 27. A layer 28 of pressure-sensitive adhesive (e.g., as can be provided by using No. 950 Adhesive Transfer Tape, available from 3M Company, St. Paul, MN) is disposed on the second strip 27 and is adapted to adhere the second strip 27 to an inner surface 29 of the threshold 14 in a position to afford separable face-to-face contact of the first and second strips 26 and 27 due to magnetic attraction when the door 12 is closed.

Preferably, the first strip 26 is of a flexible magnetized material sold under the trademark "Plastiform" by Minnesota Mining and Manufacturing Company of St. Paul, Minn.; and the second strip 27 is of magnetic stainless steel so that it will not rust.

Preferably, the flexible portion 20 of the extrusion is of a thermoplastic rubber which provides good low temperature flexibility (e.g., No. 8510 thermoplastic rubber available from Uniroyal, Inc., Middlebury, Conn.) and the stiff portion 17 is of a compatible material that provides its stiff property (e.g., such as the material made by mixing 75 parts of the product sold under the trade designation No. 512-V "Tenite" available from Eastman Chemical Products, Kingsport, Tenn., with 25 parts of the No. 8510 thermoplastic rubber from Uniroyal).

It is preferred that the assembly 10 is used with thresholds 14 having an inner surface 29 to which the second strip 27 is attached which is disposed at an acute angle (e. g., about 20 to 75 degrees) measured in the cross section of the threshold 14 with respect to the bottom surface of the threshold 14.

Preferably, the extrusion 16 has a flexible lip 31 along its first edge 18 projecting normal to its inner surface 22 having a height just sufficient to cover the adjacent edge of the layer 23 of pressure-sensitive adhesive on the stiff portion 17 when the stiff portion 17 is adhered to the door 12, thereby covering the layer 23 of adhesive to add to the esthetic appearance of the assembly 10 and to restrict dirt from collecting on the edge of the layer 23 of adhesive.

Figure 5:
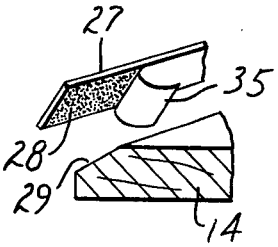
FIGS. 3, 4 and 5 are fragmentary perspective views illustrating the installation of the weatherstrip assembly of FIG. 2 on the door and threshold shown in FIG. 1.
Figure 3:
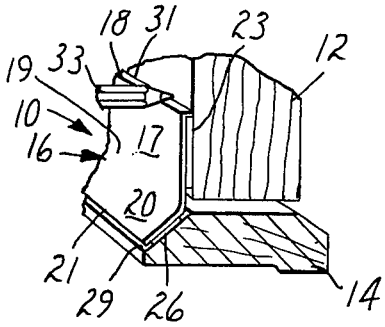
Figure 4:
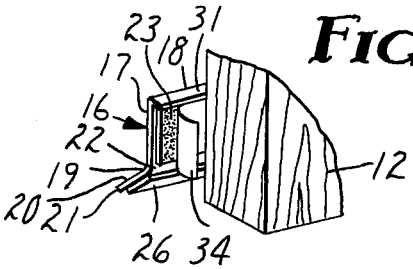

To install the weatherstrip assembly 10, a person first measures the width of the door 12 to which the assembly 10 is to be attached, and if necessary, cuts the weatherstrip assembly 10 to the appropriate length. He then test-positions the extrusion 16 at the bottom of the door 12 with its stiff portion 17 along the inner surface of the door 12 and its flexible portion 20 extending below the bottom edge of the door 12 and along the threshold 14 (FIG. 3), and marks (as with a pencil 33) a position for the first edge 18 on the door 12 and the outer edge 21 on the threshold 14 that will afford smooth surfaces for the layers 23 and 28 of pressure-sensitive adhesive to adhere to on the door 12 and threshold 14 respectively. He then removes release liners 34 and 35 that are initially provided over the layers 23 and 28 of adhesive (FIGS. 4 and 5), applies the second strip 27 to the threshold 14 at the marked location, and applies the extrusion 16 to the door 12 at the marked location.

Subsequently, when the door 12 is opened, the strips 26 and 27 will separate. When the door 12 is again closed, the strip 26 carried by the extrusion 16 attached to the door 12 will move adjacent the strip 27 adhered to the threshold 14 and the magnetic attraction therebetween will cause the strips 26 and 27 to move into face-to-face relationship, by flexing of the flexible portion 20 if necessary, to restrict movement of air, etc., therebetween.

We claim:

1. A weatherstrip assembly adapted to seal between the bottom of an exterior door and an inner surface of its threshold, said assembly comprising:

an integral polymeric extrusion comprising a stiff strip-like portion having first and second generally parallel edges, and a flexible strip-like portion extending from the second edge of said stiff portion and having an outer edge generally parallel to said second edge, said stiff and flexible portions defining an inner surface;

means for attaching said stiff portion to the vertical surface of a said door with the flexible portion extending below the bottom edge of the door;

a pair of magnetically attracted strips including a first strip attached on said inner surface along said flexible portion adjacent said outer edge, and a second strip; and means for attaching said second strip to the inner surface of a said threshold in a position to afford separable face-to-face contact of said strips due to magnetic attraction therebetween when the door is closed.

2. A weatherstrip assembly according to claim 1 wherein said extrusion includes a flexible lip along said first edge and projecting normal to said inner surface to cover the adjacent edge of said layer of pressure-sensitive adhesive on said stiff portion when said stiff portion is adhered to said door.

3. A weatherstrip assembly according to claim 1 or claim 2 wherein said first strip attached to said flexible portion is of a flexible magnetized material, and said second strip is of magnetic stainless steel.

4. A weatherstrip assembly according to claim 1 further including release liners over said layers of pressure-sensitive adhesive.

5. A weatherstrip assembly according to claim 1 or claim 2 wherein said polymeric material comprises a thermoplastic rubber.

6. A weatherstrip assembly according to claim 1 wherein said means for attaching said stiff portion comprises a layer of pressure sensitive adhesive deposed on said inner surface along said stiff portion, and said means for attaching said second strip also comprises a layer of pressure sensitive adhesive.

* * * * *

UNITED STATES PATENT AND TRADEMARK OFFICE

CERTIFICATE OF CORRECTION

PATENT NO. : 4,463,523

DATED : August 7, 1984

INVENTOR(S) : John J. Mailand and Charles D. Huber

It is certified that error appears in the above—identified patent and that said Letters Patent is hereby corrected as shown below:

Col. 1, line 48, "where" should read --wherein--.

Col. 1, lines 49-50, "having attached thereto release liners that are removed when the weatherstrip assembly is installed" should be deleted.

Col. 1, line 55, "having attached thereto release liners that are removed when the weatherstrip assembly is installed" should be inserted.

Signed and Sealed this

*Twenty-sixth* Day of *March 1985*

[SEAL]

*Attest:*

DONALD J. QUIGG

*Attesting Officer* *Acting Commissioner of Patents and Trademarks*